US006311968B1

(12) United States Patent
Linder et al.

(10) Patent No.: US 6,311,968 B1
(45) Date of Patent: Nov. 6, 2001

(54) METHOD OF PRODUCING PRINTED PRODUCTS BY INSERTING PARTIAL PRODUCTS AND/OR ENCLOSURES INTO A PRIMARY PRODUCT, AND DEVICE FOR EXECUTING THE METHOD

(75) Inventors: Heinz Linder, Zofingen; Albert Eugster, Strengelbach; Felix Kramer, Vordemwald, all of (CH)

(73) Assignee: Grapha-Holding AG, Hargiswil (CH)

( * ) Notice: Subject to any disclaimer, the term of this patent is extended or adjusted under 35 U.S.C. 154(b) by 0 days.

(21) Appl. No.: 09/178,736

(22) Filed: Oct. 27, 1998

(30) Foreign Application Priority Data

Oct. 27, 1997 (EP) ..... 97810799

(51) Int. Cl.[7] ..... B42C 19/04

(52) U.S. Cl. ..... 270/52.25; 270/52.23; 270/52.14; 270/52.19

(58) Field of Search ..... 270/52.16, 52.17, 270/52.23, 52.25, 52.24, 52.27, 52.19

(56) References Cited

U.S. PATENT DOCUMENTS

| | | | | |
|---|---|---|---|---|
| 2,796,255 | * | 6/1957 | Mitchell | 270/52.2 |
| 3,275,316 | * | 9/1966 | Cleary, Jr. | 270/52.24 |
| 3,988,016 | * | 10/1976 | Merker et al. | 270/52.24 |
| 4,046,367 | * | 9/1977 | Merker et al. | 270/52.24 |
| 4,133,521 | * | 1/1979 | Muller | 270/52.2 |
| 4,477,067 | * | 10/1984 | Wise | 270/52.2 |
| 4,709,910 | * | 12/1987 | Honegger | 270/52.3 |
| 5,269,504 | * | 12/1993 | Backman | 270/52.2 |

FOREIGN PATENT DOCUMENTS

| | | |
|---|---|---|
| 2706353 C2 | 8/1977 | (DE) . |
| 0 241 634 A1 | 10/1987 | (EP) . |
| 0 336 062 B1 | 10/1989 | (EP) . |
| 0 475 192 A2 | 3/1992 | (EP) . |
| WO98/33656 * | 8/1998 | (EP) . |
| WO 87/07881 | 12/1998 | (WO) . |

* cited by examiner

*Primary Examiner*—Christopher P. Ellis
*Assistant Examiner*—Patrick Mackey
(74) *Attorney, Agent, or Firm*—Venable; Robert Kinberg

(57) ABSTRACT

A method and device for producing printed products wherein first primary products are supplied, respectively, fold first to successive, uniformly-spaced pockets disposed transversely to a conveying direction at a beginning of a first segment of a production path formed by feeders. Subsequently, the first primary product in each pocket is grasped at a protruding gripping edge and opened for insertion of a partial product or enclosure. A further primary product is supplied, respectively, to the successive pockets on a further segment adjoining the first segment of the production path for producing a further printed product, including partial products or enclosures, in the successive pockets.

13 Claims, 8 Drawing Sheets

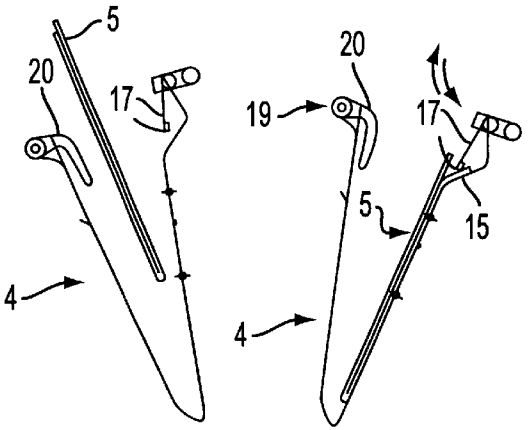
FIG. 4A
FIG. 4B
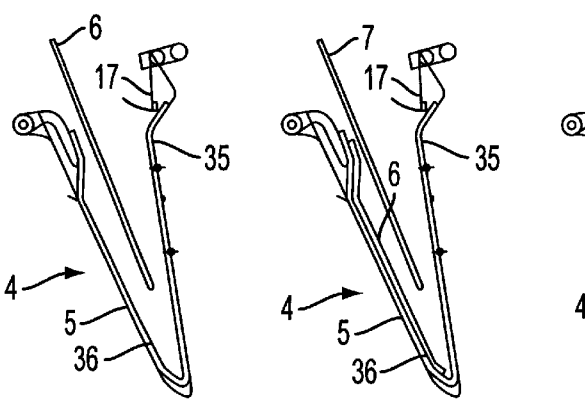
FIG. 4C
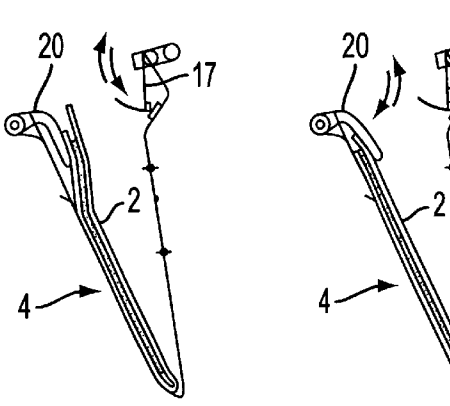
FIG. 4D
FIG. 4E
FIG. 4F
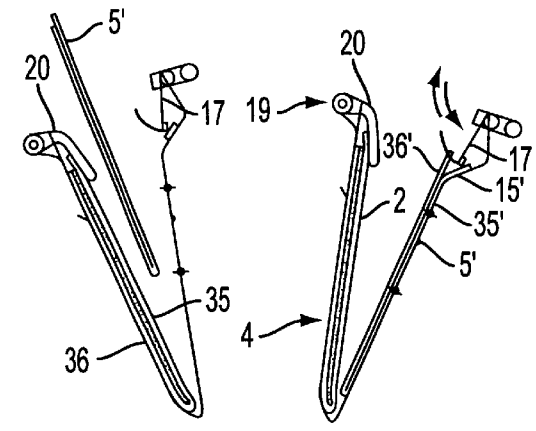
FIG. 4G
FIG. 4H
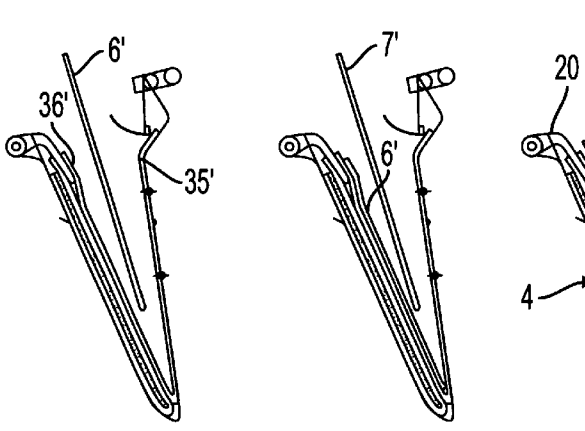
FIG. 4I
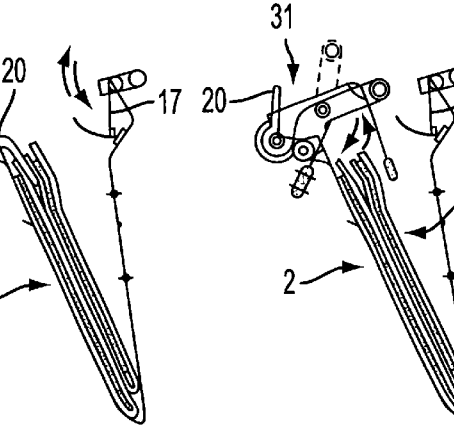
FIG. 4J
FIG. 4K
FIG. 4L

METHOD OF PRODUCING PRINTED PRODUCTS BY INSERTING PARTIAL PRODUCTS AND/OR ENCLOSURES INTO A PRIMARY PRODUCT, AND DEVICE FOR EXECUTING THE METHOD

CROSS-REFERENCE TO RELATED APPLICATIONS

Priority is claimed with respect to European Patent Application No. 97810799.3 filed in the European Patent Office on Oct. 27, 1997, the disclosure of which is incorporated therein by reference.

BACKGROUND OF THE INVENTION

The invention relates to a method of producing printed products by inserting partial products and/or enclosures into a primary product, which is supplied, fold-first, to successive, uniformly-spaced pockets disposed transversely to the conveying direction at the beginning of a production path formed by feeders, the product subsequently being grasped at a protruding gripping edge and opened for the insertion of partial products and/or enclosures.

Methods of this type are executed by insertion machines. Such machines are described and illustrated in, for example, patent documents DE-C2-27 06 353, EP-B1-0 336 062 and EP-A2-0 475 192.

These known insertion machines produce about 40,000 copies per hour of a printed product, such as a newspaper, that typically comprises an actual outer portion, or primary product, and one or more partial products and/or enclosures that have been inserted into the primary product, also referred to as pre-products, as they are usually available for processing before the primary product.

An obvious way to attain a substantially higher production output would be to operate the relevant processing components at a correspondingly higher speed. This measure has proven insufficient, however, because the available insertion system, the automatic feeder loading and the removal system would not assure reliable production with an output of over 50,000 copies or printed products per hour.

SUMMARY OF THE INVENTION

It is an object of the invention to create a method of producing printed products with which a significantly higher production output can be attained with unlimited reliability using the insertion system described at the outset.

The above and other objects are accomplish according to one aspect of the invention by the provision of a method for producing printed products, comprising: supplying first primary products, respectively, fold first to successive, uniformly-spaced pockets disposed transversely to a conveying direction at a beginning of a first segment of a production path formed by feeders; subsequently grasping the first primary product in a respective one of the pockets at a protruding gripping edge and opening the primary product for insertion of a partial product or enclosure; and supplying a further primary product, respectively, to the successive pockets on a further segment adjoining the first segment of the production path for producing a further printed product, including partial products or enclosures, in the successive pockets.

The invention thus utilizes the production of a plurality of printed products in one pocket for attaining a higher production output.

With the method of the invention, 40,000 copies each of two identical printed products, or 40,000 copies each of two different printed products, or 40,000 copies of one printed product can be produced with the tried-and-true insertion system, with the feeder capacity being doubled in the first two cases.

To make good use of the existing operating system, and augment it with simple measures, the printed product that was previously completed in the pocket is held securely or retained against the trailing pocket wall so that the further primary product can be provided with partial products and/or enclosures.

Thus, the further primary product can advantageously be opened between the first printed product and the leading pocket wall so it can be provided with the aforementioned items.

To this end, and according to another aspect of the invention there is provided a device for producing printed products by inserting at least one inner partial product or enclosure into an outer primary product, comprising: a conveying device that circulates along a production path formed by feeders in a conveying direction and comprises a plurality of uniformly-spaced, successive pockets disposed transversely to the conveying direction for receiving the products, fold first, and enclosures, the pockets each including pocket walls, means for opening the primary product and a retaining device for holding a front side of a complete printed product, relative to the conveying direction, against a pocket wall.

BRIEF DESCRIPTION OF THE DRAWINGS

The invention is described below in conjunction with two embodiments illustrated in the drawings, which contain all details not mentioned specifically in the description.

FIGS. 4*a*–4*l* show an enlarged representation of the production phase according to the symbol sequence of FIG. 1.

DETAILED DESCRIPTION OF THE INVENTION

Figure 1:
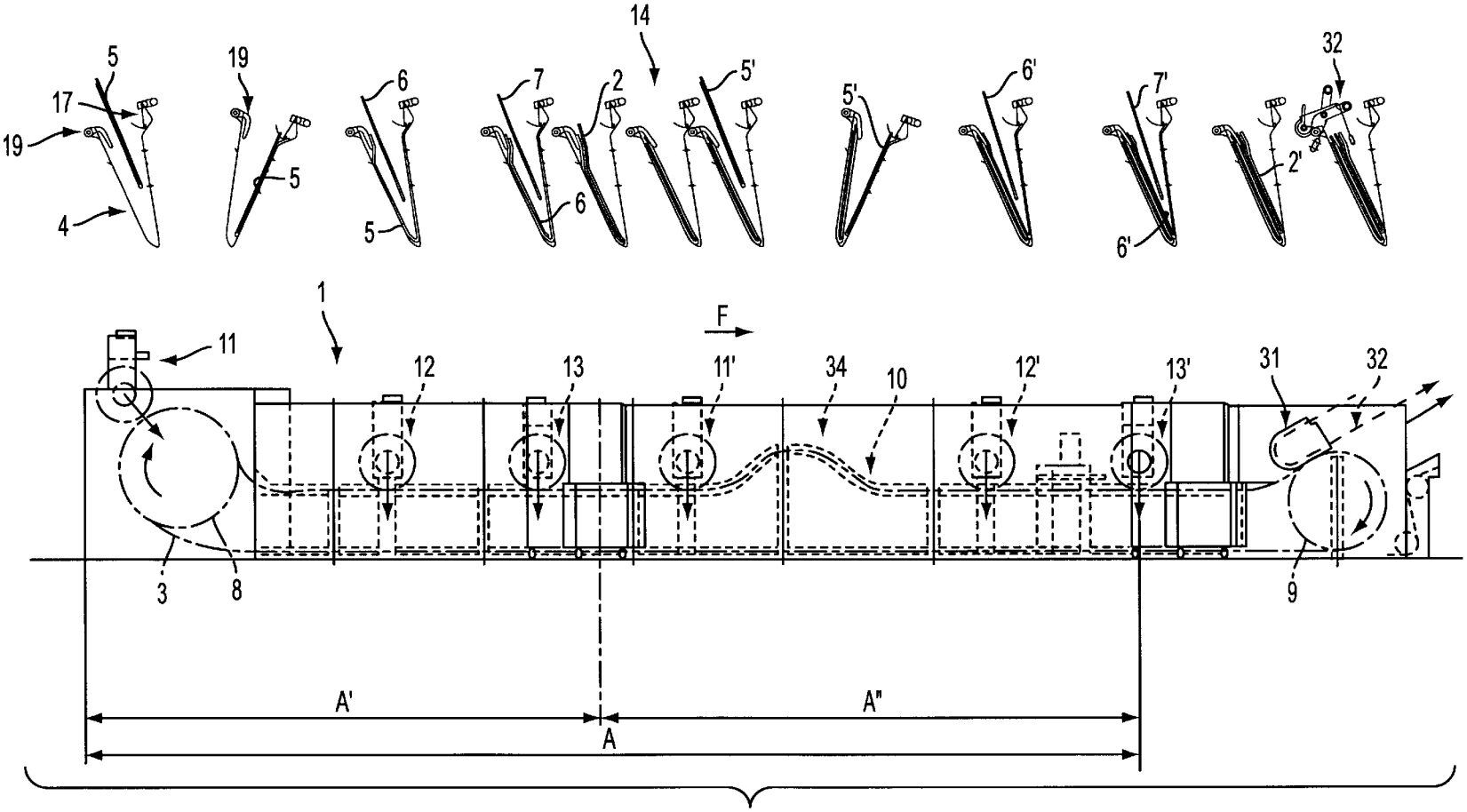
FIG. 1 is a schematic showing a side view of the arrangement of a device of the invention and a representation of the production phase employing a symbol sequence above the side view.

Referring to FIG. 1, there is shown, in a lower portion of the figure, a schematic side view of an arrangement of a device 1, namely an insertion machine, for producing printed products 2, 2', and, in an upper portion of the figure, a symbol sequence 14 comprising symbolic indicators of the production phase of the printed products 2, 2' on a production path A, which comprises two segments A' for the first printed product 2, and A" for the second printed product 2'. Production path A is formed by an endless pulling element 3 comprising two parallel chains, between which a plurality of successive pockets 4 are disposed with uniform spacing, seen in a conveying direction F, for receiving a primary product 5 and partial products 6 and enclosures 7. Primary products 5 are known from newspaper production, among other things, as the outer, actual part, while the partial products 6, also called pre-products, are inserted into primary product 5 during the production of printed product 2, 2'. Pulling element 3, or its upper run, which circulates about horizontal axes on twin chain wheels, and pockets 4 of a conveying device 10 constitute production path A, along which numerous feeders 11, 12, 13 are disposed spaced from one anther.

FIG. 1 shows an arrangement of device 1 of the invention, with which two identical printed products 2, 2' are respectively produced in one of pockets 4 on segments A' and A" of production path A, with conveying device 10 being at least as long as production path A. Symbol sequence 14 above device 1 shows the respective production phase of a printed product 2, 2' in respective pockets 4.

Figure 2:
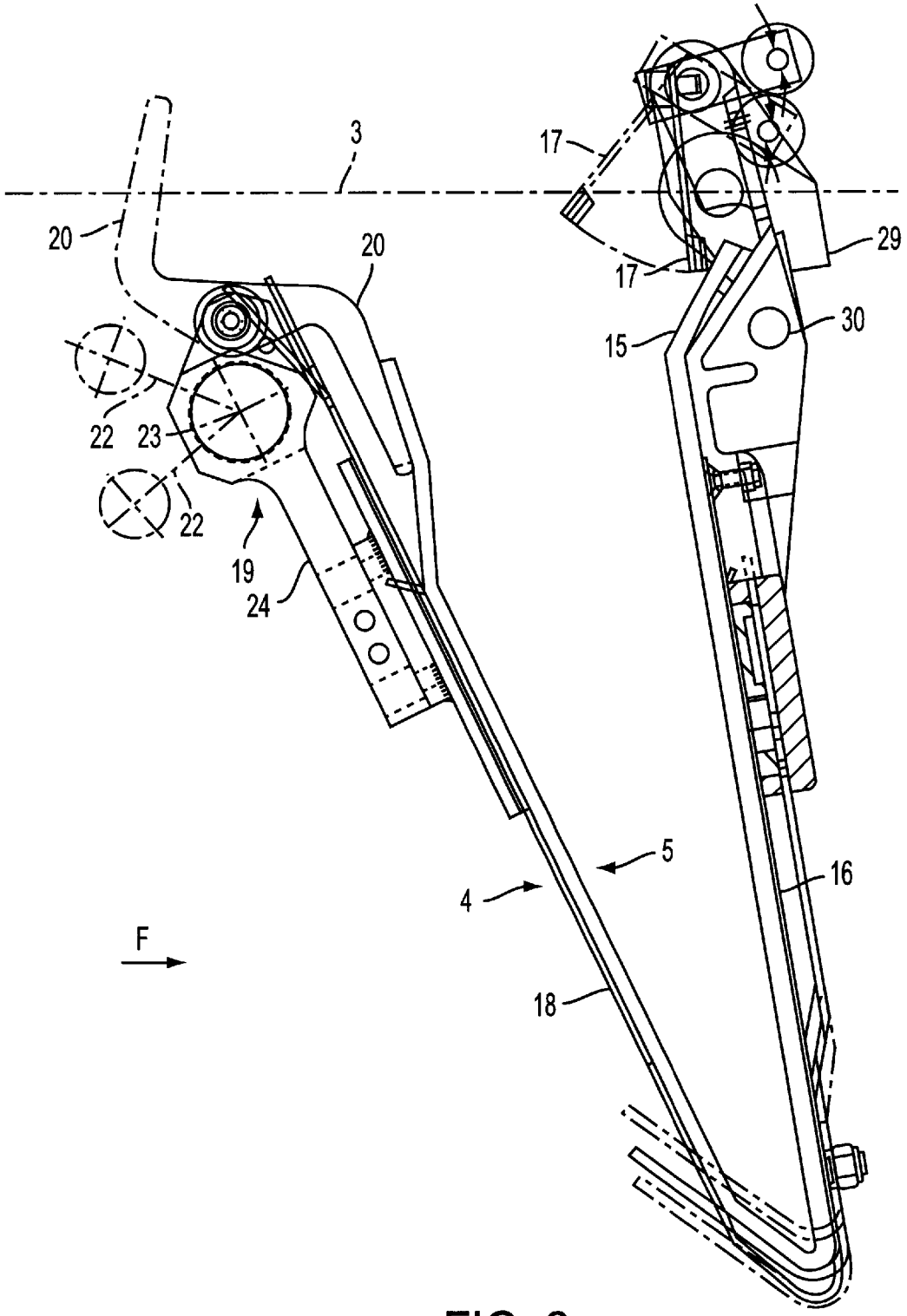
FIG. 2 is a side view of a pocket of the device shown in FIG. 1.

Production begins on the left side of device 1 shown in FIG. 1 with the delivery of primary product 5 (as indicated by the arrow R) by primary-product feeders 11 into one of the consecutive pockets 4 of conveying device 10, the pocket arriving on twin chain wheel 8. Primary product 5 supplied to pocket 4 is displaced toward a leading or front pocket wall 16, seen in the conveying direction F, through a rotational motion of a known initiator 33 visible in FIG. 3. As shown in FIG. 2, a gripper 17 that has been deflected from an inoperative position indicated as a dot-dash line displaces a gripping edge 15 of a front part 35 of primary product 5 toward a chamfered upper edge of front pocket wall 16, and holds it there, whereupon a following part 36 of primary product 5 is placed against a trailing or rear pocket wall 18 at the latest on the horizontal conveying path, causing the primary product to open for receiving partial products 6 and/or enclosures 7. The symbol sequence 14 refers to an open primary product 5 in pocket 4. To insert the items into primary product 5, pocket 4 is displaced into the position shown in FIG. 2, i.e., trailing pocket wall 18 assumes a steeper inclination than the leading wall relative to the vertical. Pocket 4 holding primary product 5, which is open toward the top, passes feeders 12 and 13, which insert partial product 6 and enclosure 7, for example, in this order, as indicated by symbol sequence 14 above feeders 12 and 13. Partial product 6 and enclosure 7 then rest against the trailing pocket wall 18, with the products being combined to form a complete printed product 2.

Gripper 17 is immediately released from gripping edge 15 by a control slide (not visible) , so that, because of its inclined position, front part 35 of primary product 5, acted upon by the gripper, lies against enclosure 7 that was inserted last. The complete printed product 2 is then held securely against trailing pocket wall 18 by a retaining device 19 secured to an upper end of pocket wall 18, such that the complete printed product 2 cannot be opened again. For this purpose, a holder 20, which is initially located between trailing pocket wall 18 and the part of primary product 5 resting against this wall, briefly pivots upward and back, so a complete printed product 2 is held securely against trailing pocket wall 18 by holder 20 in front it.

Figure 3:
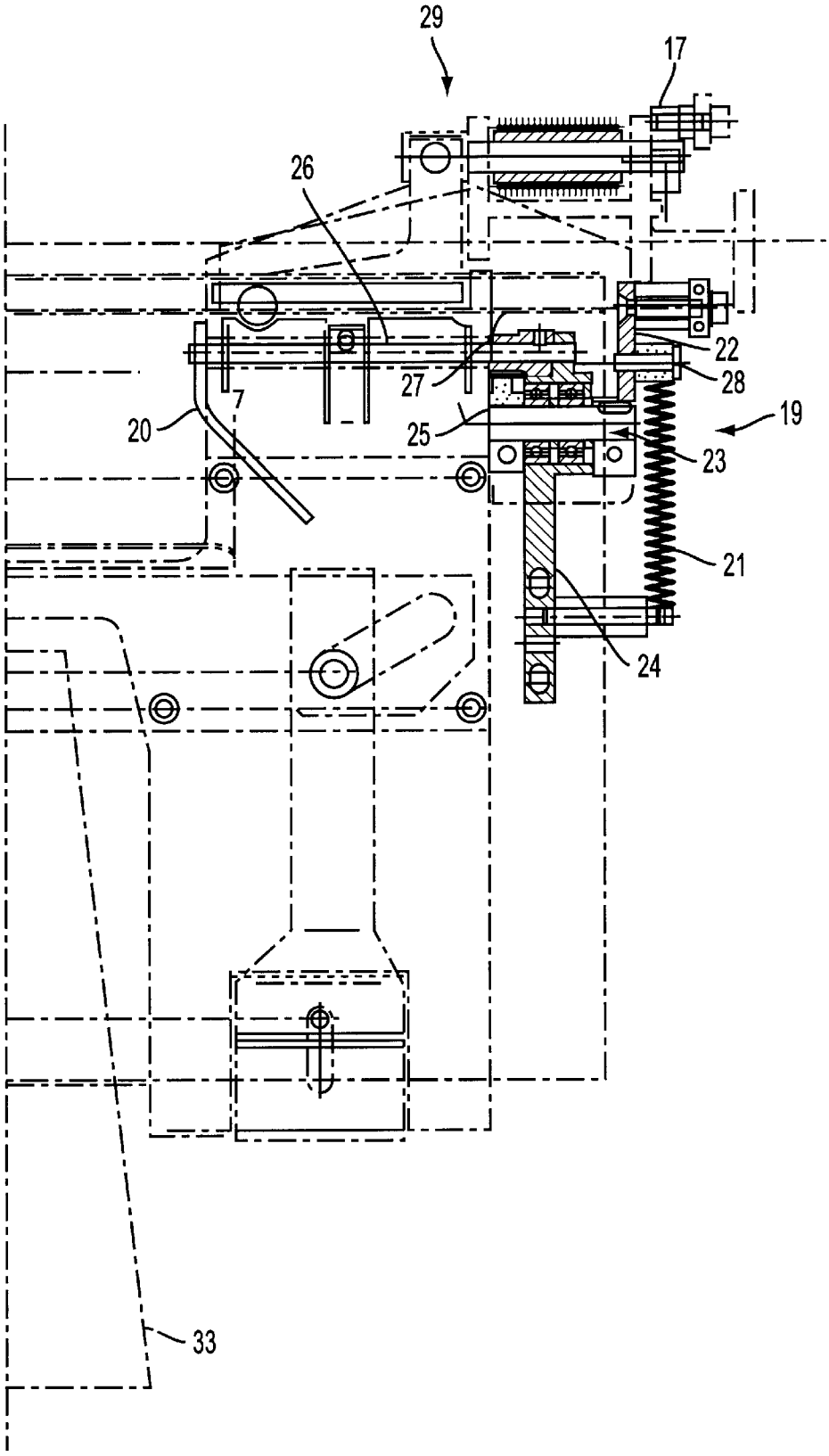
FIG. 3 is a view of the pocket shown in FIG. 2, as seen in the conveying direction F.

Holder 20 of retaining device 19 is yoke-shaped and employs a force of a spring 21 to hold printed product 2 in the vicinity of the open side. The effect of holder 20 is By triggered by a rocking lever 22, which can be displaced over a dead center and run onto a cam track (not shown). Rocking lever 22 is connected to a shaft 23, which is seated in a support 24 secured to trailing pocket wall 18. A toothed segment 25, which is adjustable with respect to a pivoting angle of rocking lever 22 and engages a toothed pinion 27 connected to a pivot shaft 26 of holder 20 for transmitting a pivoting movement, is secured to a shaft 23. The pivoting angle of rocking lever 22 is shown in FIG. 2. FIG. 3 shows how spring 21 is secured, on the one hand, to a stationary support 24 and, on the other hand, to a pin 28 secured to rocking lever 22. One skilled in the art can infer further details about the holder actuation from FIGS. 2 and 3.

As the completed printed product 2 leaves segment A' of production path A, it is still held against the trailing pocket wall 18 by retaining device 19 (refer to symbol sequence 14). The pocket thus remains accessible, that is, feeder 11' delivers a new primary product 5' between leading pocket wall 16 and printed product 2 held in pocket 4, specifically against trailing pocket wall 18, by holder 20. Afterward, pocket 4 traverses a region 34 that curves upward on segment A" of production path A so that a further primary product 5' in pocket 4 can be opened. Primary product 5', supported in the buckle region 34 by initiator 33 following closely behind pocket 4, is displaced toward front pocket wall 16, where front part 35 of the primary product 5', resting against wall 16, is gripped by gripper 17 at gripping edge 15 before pocket 4 is displaced back into the filling position shown in FIG. 2. In the filling position, succeeding part 36 of primary product 5' comes to rest against the previously-completed printed product 2 and partially against holder 20, which is pivoted in pocket 4, and passes feeders 12' and 13', which supply a partial product 6' and/or an enclosure 7'. Gripper 17 now pivots into an inoperative position (shown in a dot-dash line), so front part 35 of primary product 5' is released and, because of the inclination in pocket 4 and air resistance, leans against enclosure 7' that was inserted last.

Before pocket 4 reaches a delivery 31 of a transporter 32 at the end of production path A, holder 20 is pivoted out of pocket 4 (position shown as a dot-dash line in FIG. 2) by the passing of a cam track (not visible) through the rocking lever.

At the end of production path A, printed products 2 and 2', which are pressed closely together in pocket 4 because of a change in the conveying direction, are gripped and conveyed away together by clips 31 of transporter 32, which are driven with the same cadence and in the same direction.

Furthermore, two pockets 4 following one after the other are connected, on the one hand, by suspension devices 29, which are disposed on both sides at the upper end of front pocket wall 16, to the chains forming pulling element 3 and, on the other hand, by trailing pocket wall 18 to a securing device 30.

The depth of a pocket 4 can be set and adjusted, as indicated by FIGS. 2 and 3 via a slot in an adjustble piece 46 and a screw and nut arrangement 47 for fixing the position of the adjustable piece.

FIGS. 4*a* through 4*l* show enlarged representations of the production phases symbolized by symbol sequence 14 of FIG. 1.

FIGS. 5 through 8 show an alternative embodiment of a device 1' for producing two printed products 2, 2' in a pocket 4. This embodiment does not require a change in direction of conveying device 10 for opening the second primary product 5', and the embodiment of the retaining device 19 is simplifed. The products can be processed carefully. For this purpose, a retaining device 19' (FIG. 7) is embodied in a form of a planar flap 41, unlike the retaining devices in FIGS. 1 through 4, and can pivot at a lower end of pocket 4 about a horizontal axis 42 extending transversely to conveying direction F. Flap 41 is connected to a control lever 43 (FIGS. 5 and 6) that is adjustable about horizontal axis 42 and runs onto a slide or cam track (not shown) for actuation.

Figure 5:
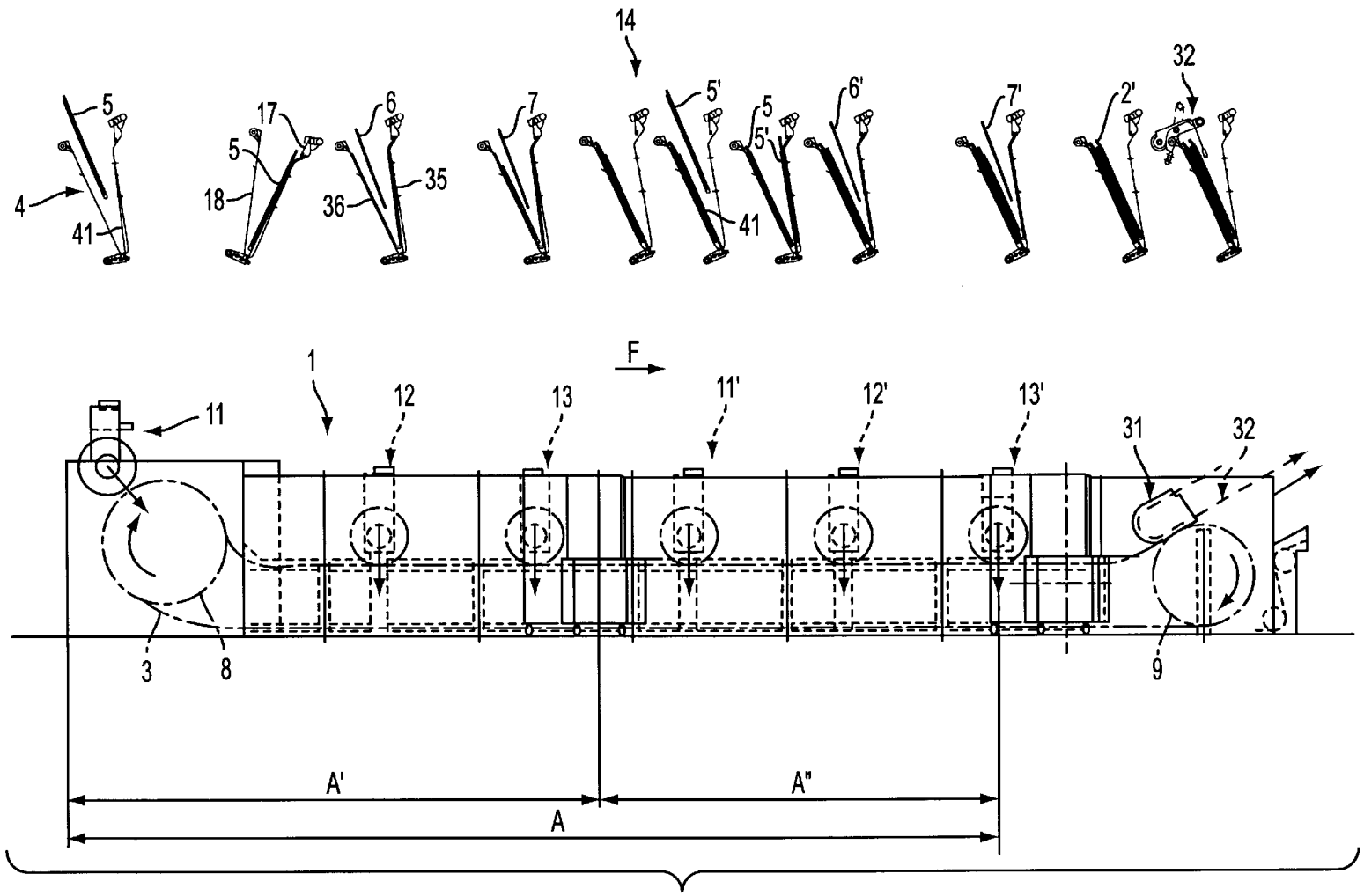
FIG. 5 is a schematic, similar to FIG. 1, showing a side view of the arrangement of an alternative embodiment of the device of the invention, and a representation of the production phase employing a symbol sequence above the side view.

FIG. 5 illustrates a symbol sequence 14', above device 1', which represents the respective production phases.

At a time that feeder 11 delivers primary product 5, flap 41 lies against leading pocket wall 16 (shown as a dot-dash line in FIG. 6) because of a tension spring 21', which is secured to trailing pocket wall 18, and a control lever 43. Further along the path on twin chain wheel 8, pocket 4 tilts in conveying direction F, so primary product 5 tips against flap 41 at leading pocket wall 16, where gripper 17 grips it at gripping edge 15 and clamps it against a chamfered upper edge of front pocket wall 16 in the next step. Afterward, pocket 4 is displaced into the position provided for filling with partial products 6 and/or enclosures 7 (see symbol sequence 14 above feeder 12). On the way, the rear, shorter part 36 of primary product 5 falls back against trailing pocket wall 18 due to the change in position of pocket 4 and air resistance. As the opened primary product passes feeders 12 and 13, a partial product 6 and then an enclosure 7 are supplied to primary product 5. Now gripper 17 opens and, due to the action of the aforementioned slide on control lever 43, front part 35 of primary product 5 is held by flap 41, which was deflected outward counter to the force of spring 21', against enclosure 7 that was last supplied, causing a space for further primary product 5' to open between flap 41 and leading pocket wall 16. FIG. 5 indicates this situation, which is noted above feeder 11' in symbol sequence 14'.

Figure 8A:
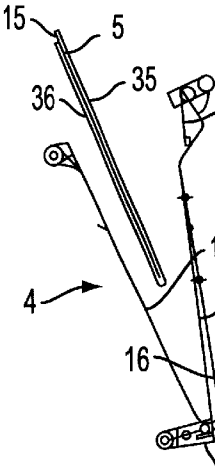
FIGS. 8*a*–8*k* show an enlarged representation of the production phase according to the symbol sequence of FIG. 5.
Figure 8B:
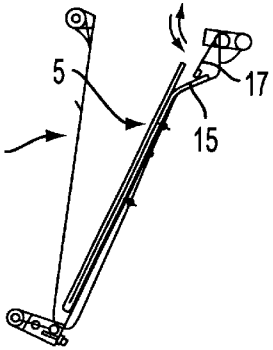
Figure 8C:
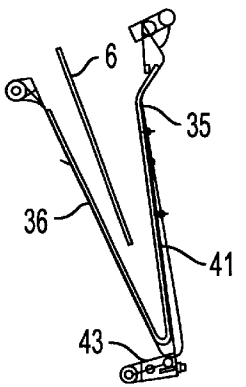
Figure 8D:
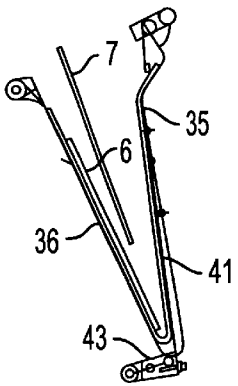
Figure 8E:
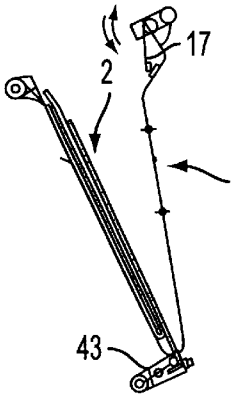
Figure 8F:
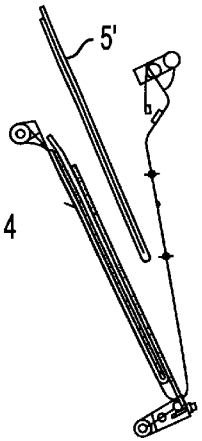
Figure 8G:
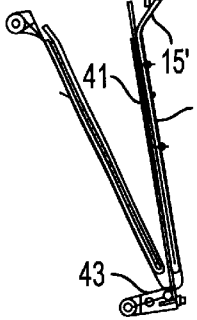
Figure 8H:
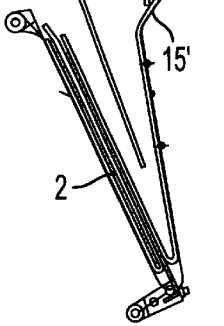
Figure 8I:
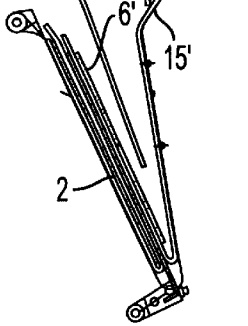
Figure 8J:
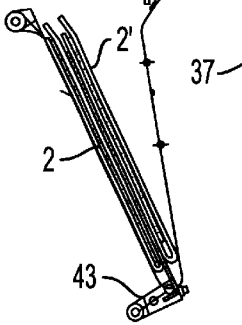
Figure 8K:
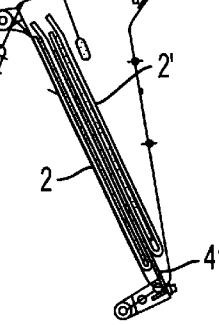

Feeder 11' supplies a further primary product 5' to open pocket 4 (FIG. 8*f*) which will lie against flap 41. Gripper 17 grips gripping edge 15' through a pivoting movement of flap 41 toward leading pocket wall 16, so gripper 17 can immediately displace gripping edge 15' toward a chamfered upper region of leading pocket wall 16 (FIG. 8*g*). The flap 41 is now placed back against the previously-produced printed product 2 by control lever 43, and is followed by the rear part 361 of the primary product 5'. The primary product 5' is now open to receive partial products 6' and/or enclosures 7', as ensues from the symbol sequence 14' above feeders 12' and 13' and FIGS. 8*h* and 8*i*. At the end of production path A, printed products 2, 2' located in a pocket 4 (FIG. 8*j*) are lifted together by a delivery 31 of a transporter 32 and conveyed further (FIG. 8*k*).

Figure 6:
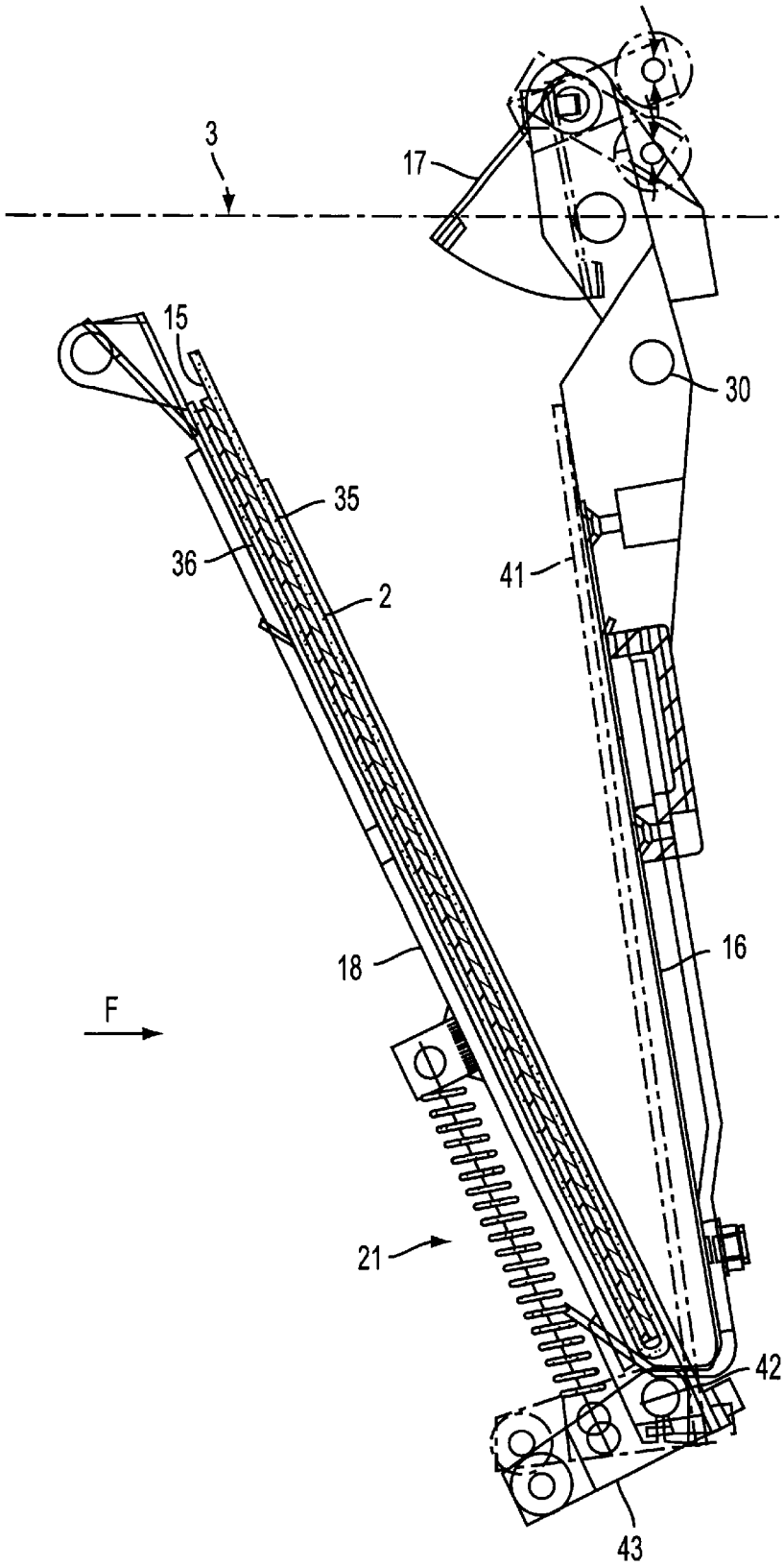
FIG. 6 is a side view of a pocket of the device shown in FIG. 5.
Figure 7:
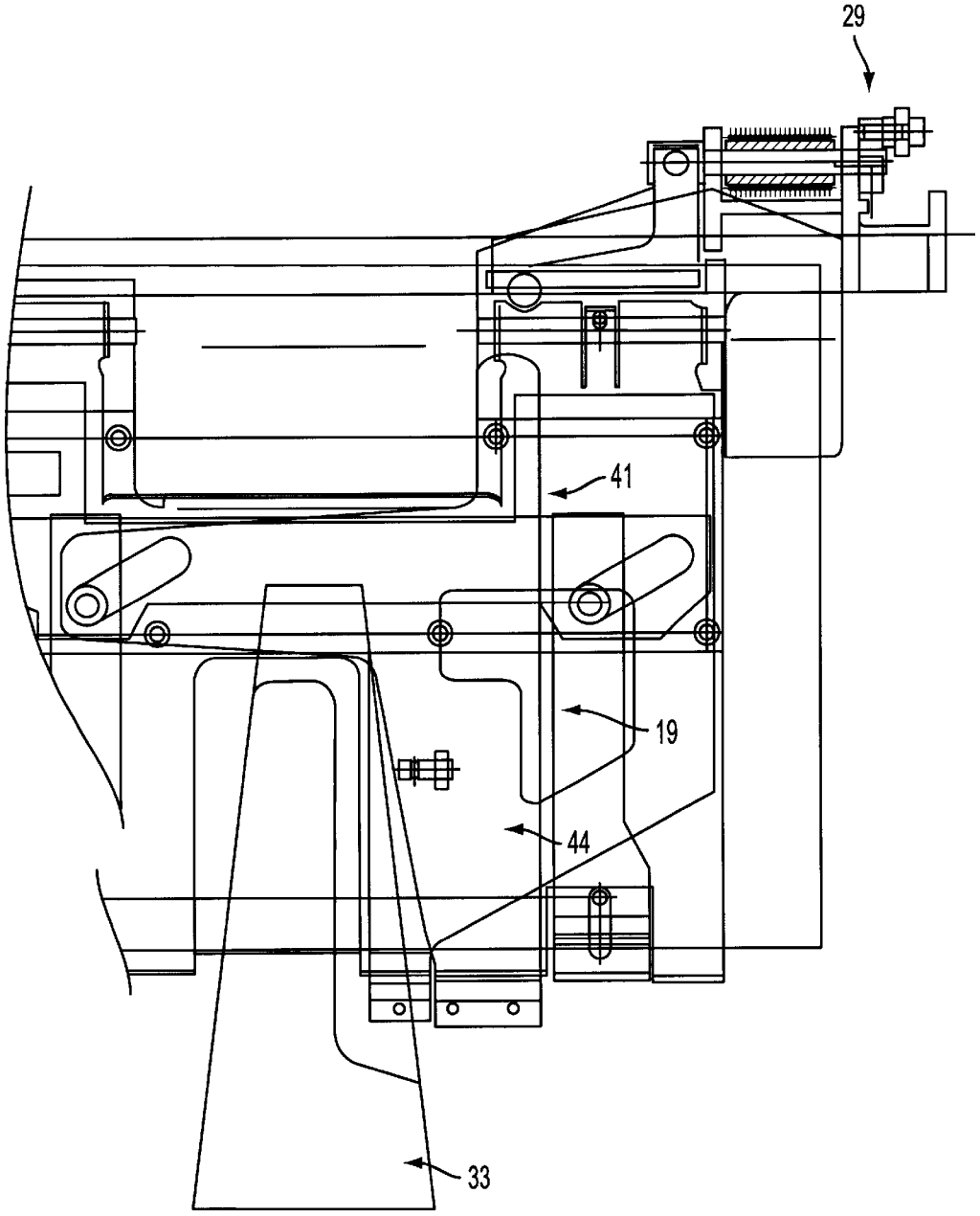
FIG. 7 is a view of the pocket shown in FIG. 6, as seen in the conveying direction F.

FIGS. 5 and 6 show the embodiment of the individual pockets 4 with a flap 41 in greater detail. In accordance with FIG. 7, flap 41 is smaller in height in the gripping region of printed products 2, 2' because of clips of the transporter 32 than in the working region of the gripper 17, by which primary product 2, 2' is clamped at gripping edge 15, 15', respectively. The narrow space conditions have led to a specific geometrical shape of flap 41, with the lower, transverse work region being tongue-shaped and ending in an extension arm 44 connected to control lever 43. Control lever 43 in turn has a control ring, which permits an adjustment in the position of flap 41 within pocket 4.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A method for producing printed products, comprising:

supplying first primary products, respectively, fold first, to successive, uniformly-spaced pockets disposed transversely to a conveying direction at a beginning of a first segment of a production path formed by feeders;

subsequently gripping the first primary product in a respective one of the successive pockets at a protruding gripping edge and opening the primary product for insertion of at least one partial product or enclosure; inserting the partial product or enclosure, then folding the first primary product to form a first completed product; and then supplying a further primary product, respectively, to the successive pockets on a further segment adjoining the first segment of the production path for producing a further printed product, including partial products or enclosures, in the successive pockets, wherein each pocket includes a leading and a trailing pocket wall relative to the conveying direction, and the method further includes holding the first completed printed product on the first segment in each pocket against the trailing pocket wall.

2. The method according to claim 1, further comprising opening the further primary product between the first printed product in the pocket and the leading pocket wall of the pocket for receiving partial products or enclosures into the further primary product.

3. The method according to claim 1, wherein the method further includes holding the further printed products completed on the first segment in each pocket against the trailing pocket wall.

4. The method according to claim 1, wherein additional primary products are supplied in each respective pocket.

5. A device for producing printed products by inserting at least one inner partial product or enclosure into an outer primary product, comprising:

a conveying, device that circulates along a production path formed by feeders in a conveying direction and comprises a plurality of uniformly-spaced, consecutive pockets disposed transversely to the conveying,g direction for receiving the primary products, fold first, and enclosures, the pockets each including a leading and a trailing pocket wall relative to the conveying direction, means for opening the primary product, a holding device for gripping a front side of a primary printed product against the leading pocket wall relative to the conveying direction, wherein the holding device comprises a gripper disposed near the leading pocket wall which can be actuated to act on an edge region of an open side edge of the primary printed product, and a retaining device comprising a holder constructed and arranged proximal to the trailing pocket wall such that the holder is displaceable to an operative position so that a complete printed product is held against the trailing wall.

6. The device according to claim 5, wherein the holder is secured to an upper end of the trailing pocket wall.

7. The device according to claim 5, wherein the pocket walls of each pocket comprise a leading and a trailing pocket wall relative to the conveying direction and the trailing pocket wall is arranged for contacting a first completed printed product and the retaining device is coupled to the trailing pocket wall.

8. The device according to claim 5, wherein the holder comprises a yoke that can pivot into the pocket by an actuating element for holding the printed product.

9. The device according to claim 5, wherein the retaining device comprises a flap hinged in a lower end region of the pocket pivotable transversely to the conveying direction within the pocket.

10. The device according to claim 5, further including an actuating element operatively connected to the flap for actulating the flap.

11. The device according to claim 10, wherein the actuating element comprises a control lever that can be brought into an operative connection with a cam track.

12. The device according to claim 10, wherein the trailing pocket wall and the flap comprise a retaining device that acts on the printed product.

13. The device according to claim 10, wherein the flap has a recess in an upper region so that the printed products can be gripped and removed by a clip transporter.

* * * * *